US011400482B2

(12) United States Patent
Ikushima

(10) Patent No.: US 11,400,482 B2
(45) Date of Patent: Aug. 2, 2022

(54) DEVICE AND METHOD FOR DISCHARGING LIQUID MATERIAL

(71) Applicant: MUSASHI ENGINEERING, INC., Mitaka (JP)

(72) Inventor: Kazumasa Ikushima, Mitaka (JP)

(73) Assignee: MUSASHI ENGINEERING, INC., Mitaka (JP)

( * ) Notice: Subject to any disclaimer, the term of this patent is extended or adjusted under 35 U.S.C. 154(b) by 529 days.

(21) Appl. No.: 15/034,013

(22) PCT Filed: Nov. 5, 2014

(86) PCT No.: PCT/JP2014/079289
§ 371 (c)(1),
(2) Date: May 3, 2016

(87) PCT Pub. No.: WO2015/068708
PCT Pub. Date: May 14, 2015

(65) Prior Publication Data

US 2016/0279664 A1 Sep. 29, 2016

(30) Foreign Application Priority Data

Nov. 6, 2013 (JP) ..... JP2013-230464

(51) Int. Cl.
*B05C 11/10* (2006.01)
*B05C 5/00* (2006.01)
*B05C 5/02* (2006.01)

(52) U.S. Cl.
CPC ..... *B05C 11/1039* (2013.01); *B05C 5/001* (2013.01); *B05C 5/02* (2013.01); *B05C 5/0237* (2013.01)

(58) Field of Classification Search
CPC ..... B05B 12/00; B05B 1/3093; B05C 11/10; B05C 11/1039; B05C 5/02; B05C 5/001;
(Continued)

(56) References Cited

U.S. PATENT DOCUMENTS 3,743,187 A * 7/1973 Breunsbach ..... B05C 11/00 239/489
4,687,137 A * 8/1987 Boger ..... B05C 5/001 118/315

(Continued)

FOREIGN PATENT DOCUMENTS

JP 60-5251 A 1/1985
JP 60-005251 * 11/1985 ..... B05B 12/00

(Continued)

OTHER PUBLICATIONS

International Search Report dated Feb. 3, 2015, issued in counterpart International Application No. PCT/JP2014/079289. (2 pages).

(Continued)

*Primary Examiner* — Steven M Cernoch
*Assistant Examiner* — Christopher R Dandridge
(74) *Attorney, Agent, or Firm* — WHDA, LLP

(57) ABSTRACT

A discharge device and method can eliminate the influence of pump pulsation while temperature reduction of liquid material is minimized. The discharge device includes a nozzle (19) having a discharge port (28) a valve seat (31) having a communication bore (30) communicating with the discharge port, a liquid chamber (33) extending vertically, a needle (4) for opening and closing the communication bore of the valve seat, and a circulation flow passage through which the liquid material is supplied to the liquid chamber. The device further includes a rod-shaped flow passage formation member (34) provided with an outer flow passage (36) having a top opening (40) formed at an upper end and a bottom opening (41) formed at a lower end, and with an inner flow passage (35) having a bottom opening (41) in communication with an outer flow passage and a top opening (38).

16 Claims, 7 Drawing Sheets

(58) Field of Classification Search
CPC ..... B05C 5/0237; B05C 9/00; B05C 9/02; B05C 9/08; B05C 9/10; B05C 9/12; B05C 9/14; B05C 19/06; B05C 19/008; B05C 21/00; F23D 11/28; F23D 11/30
USPC ..... 239/128, 132, 125
See application file for complete search history.

(56) References Cited

U.S. PATENT DOCUMENTS

| | | | | |
|---|---|---|---|---|
| 5,076,236 | A * | 12/1991 | Yu | F02M 57/021 123/446 |
| 5,336,320 | A | 8/1994 | Hogan et al. | |
| 6,182,908 | B1 * | 2/2001 | Hamilton | B05B 1/3053 239/125 |
| 6,823,833 | B2 * | 11/2004 | Ismailov | F02D 41/40 356/28.5 |
| 9,074,568 | B2 * | 7/2015 | Kang | F02M 59/265 |
| 2015/0048120 | A1 | 2/2015 | Ikushima | |

FOREIGN PATENT DOCUMENTS

| | | | |
|---|---|---|---|
| JP | 5-111659 | A | 5/1993 |
| JP | 2000-33306 | A | 2/2000 |
| JP | 2001-276716 | A | 10/2001 |
| JP | 2002-18348 | A | 1/2002 |
| JP | 2013-192972 | A | 9/2013 |

OTHER PUBLICATIONS

International Preliminary Report on Patentability (Form PCT/IPEA/409) issued in counterpart International Application No. PCT/JP2014/079289 dated Nov. 18, 2015. (7 pages).

* cited by examiner (a)

(b)

(a)

(b)

DEVICE AND METHOD FOR DISCHARGING LIQUID MATERIAL

TECHNICAL FIELD

The present invention relates to a device and method for discharging a liquid material, and more particularly to a liquid material discharge device and method, which are featured in an inner flow passage structure. In the present invention, a rod-shaped member capable of opening and closing a communication bore, which is communicated with a discharge port, with reciprocating movement thereof is called a needle.

BACKGROUND ART

In a device for discharging a liquid material, controlling the temperature of the liquid material to be kept constant is one important factor from the viewpoint of controlling the amount and the shape of the discharged liquid material to be kept constant. Various techniques for controlling the temperature of the liquid material have been proposed so far.

Patent Document 1 discloses a viscous material discharge device for containing a viscous material, applying pressure to the inside, and discharging the viscous material from a tip, wherein the discharge device comprises a container containing the viscous material and having an opening through which the viscous material is discharged to the outside, pressure applying means for applying pressure to the inside of the container, opening-closing means for opening and closing the opening of the container through which the viscous material is discharged, adjustment means for finely adjusting the opening-closing operation of the opening-closing means from the outside, discharge means including a pipe-shaped discharge device path disposed, to reduce a useless filling space, in the opening through which the viscous material is discharged, a cap fitted over an outer periphery of the discharge means, and holding means for supporting the container and the cap, and for holding temperature constant.

Patent Document 2 discloses a painting device comprising a main tank storing a paint, painting means for discharging the paint, a first circulation tubing line arranged to circulate the paint between the main tank and the painting means, and a heater for heating the paint passing through the first circulation tubing line to a predetermined temperature, wherein the painting device further comprises a sub-tank storing the paint, a second circulation tubing line allowing the paint in the sub-tank to be stored into the sub-tank again, a resupply tubing line connected to the main tank, and changeover means disposed in the second circulation tubing line and supplying the paint, which flows through the second circulation tubing line, to the resupply tubing line.

Patent Document 3 discloses a temperature stabilization method for a wide head or a nozzle block that is used to develop a heated liquid or a molten material through a discharge port over a wide range downstream of the discharge port, wherein at least one passage for a liquid or a molten material is formed in a lengthwise direction of the wide head or the nozzle block, and a liquid or a molten material being the same as the liquid or the molten material discharged from the discharge port is supplied to pass through the passage.

CITATION LIST

Patent Documents

Patent Document 1: Japanese Patent Laid-Open Publication No. 2000-33306

Patent Document 2: Japanese Patent Laid-Open Publication No. 2001-276716

Patent Document 3: Japanese Patent Laid-Open Publication No. 2002-18348

SUMMARY OF INVENTION

Technical Problem

In the case of arranging a heater and a thermosensor near the discharge port of the discharge device as disclosed in Patent Document 1, problems arise in that a space for setting the heater, etc. is needed, and that the size and the weight of a discharge head is increased.

In the case of arranging the discharge device midway the circulation tubing line as disclosed in Patent Document 2, an accumulator or the like needs to be disposed in order to dynamically reduce pulsation of a pump.

Furthermore, when the liquid passes through a flow passage communicating the discharge port and the circulation tubing line with each other, a problem of reduction of liquid temperature occurs because a heater is not disposed in the relevant flow passage.

In the case of forming, in the nozzle block, the branched flow passage for keeping the temperature as disclosed in Patent Document 3, problems arise in that energy efficiency is poor because the liquid temperature reduces in the branched flow passage as well, and that temperature control is difficult to realize.

Meanwhile, when a discharge device is used for spraying, a nozzle tip is apt to dry in a standby mode, and therefore the nozzle tip is sometimes dipped in a solvent, e.g., a thinner, to prevent drying. In such a case, because the solvent is highly volatile and it cannot be heated to high temperature, the nozzle tip is dipped in the solvent at low temperature. This causes a problem that the nozzle tip and a liquid in the nozzle tip are cooled. In other words, a discharge device capable of minimizing reduction of the liquid temperature in the nozzle is demanded in the above application field as well.

In view of the above-described situations, an object of the present invention is to provide a discharge device and method, which can statically suppress the influence of pump pulsation while temperature reduction of a liquid material is minimized.

Solution to Problem

The present invention provides a liquid material discharge device comprising a nozzle having a discharge port that is opened downwards, a valve seat having a communication bore in communication with the discharge port, a liquid chamber extending vertically and communicating with the communication bore, a needle that is moved inside the liquid chamber in a reciprocating manner to open and close the communication bore of the valve seat, and a circulation flow passage through which the liquid material is supplied to the liquid chamber, wherein the discharge device further comprises a rod-shaped flow passage formation member provided with an outer flow passage having a top opening formed at an upper end thereof and a bottom opening formed at a lower end thereof, and with an inner flow passage having a bottom opening in communication with the outer flow passage and a top opening formed at an upper end thereof, the flow passage formation member is inserted in the liquid chamber in a state that the bottom opening of the outer flow passage and the bottom opening of the inner flow passage are communicated with the communication bore of the valve seat, and the circulation flow passage is constituted by a first flow passage that extends in a direction different from an extending direction of the needle, and that is communicated with the top opening of the outer flow passage in the flow passage formation member, a second flow passage that extends in a direction different from the extending direction of the needle, and that is communicated with the top opening of the inner flow passage in the flow passage formation member, the outer flow passage in the flow passage formation member, and the inner flow passage in the flow passage formation member.

In the liquid material discharge device described above, preferably, a diameter of the outer flow passage in the flow passage formation member is smaller than a diameter of the first flow passage. More preferably, a cross-sectional area of the outer flow passage in the flow passage formation member is not more than ½ of a cross-sectional area of the first flow passage.

In the liquid material discharge device described above, the outer flow passage in the flow passage formation member may be constituted by a groove recessed in an outer periphery of the flow passage formation member, the inner flow passage in the flow passage formation member may be constituted by a penetration bore penetrating through the flow passage formation member, and an outer diameter of the flow passage formation member may be slightly smaller than an inner diameter of the liquid chamber. Moreover, in the liquid material discharge device described above, preferably, the outer flow passage in the flow passage formation member extends around the flow passage formation member once or more in a region from an inlet to an outlet of the outer flow passage. More preferably, the outer flow passage in the flow passage formation member is spirally formed.

The liquid material discharge device described above may further comprise a needle container having the liquid chamber formed therein, and a liquid contact member having the first flow passage and the second flow passage, wherein the needle container and the liquid contact member may be detachably fixed. Preferably, the first flow passage and the second flow passage are constituted by bore that extends within the liquid contact member in a horizontal direction, and that is separated with the presence of the flow passage formation member.

In the liquid material discharge device described above, a porous member or a waterwheel member may be disposed in the outer flow passage in the flow passage formation member.

The liquid material discharge device described above may comprise a tank for storing the liquid material, a heater for adjusting a temperature of the liquid material, a pump for delivering the liquid material from the tank to the first flow passage or the second flow passage, a circulation tubing line that interconnects the tank, the pump, the first flow passage, and the second flow passage, and a controller, wherein the liquid material kept at the adjusted temperature may be supplied to the liquid chamber in a circulated manner. Moreover, the pump may deliver the liquid material to the first flow passage. Alternatively, the pump may deliver the liquid material to the second flow passage.

The present invention provides a liquid material discharge method of discharging a liquid material, which is kept at an adjusted temperature, from a discharge port with the above-described liquid material discharge device including the pump.

Advantageous Effect of Invention

According to the present invention, since the circulation flow passage is formed inside the liquid chamber extending vertically, temperature reduction of the liquid material immediately before being discharged can be minimized. Moreover, pulsation of the pump can be statically reduced through the outer flow passage having relatively high flow resistance.

BRIEF DESCRIPTION OF THE DRAWINGS

FIG. 7(*a*) is a partial enlarged view of FIG. 6(*a*), and FIG. 7(*b*) is a partial enlarged view of FIG. 6(*b*).

DESCRIPTION OF EMBODIMENTS

Embodiment for carrying out the present invention will be described below.

First Embodiment

Figure 1:
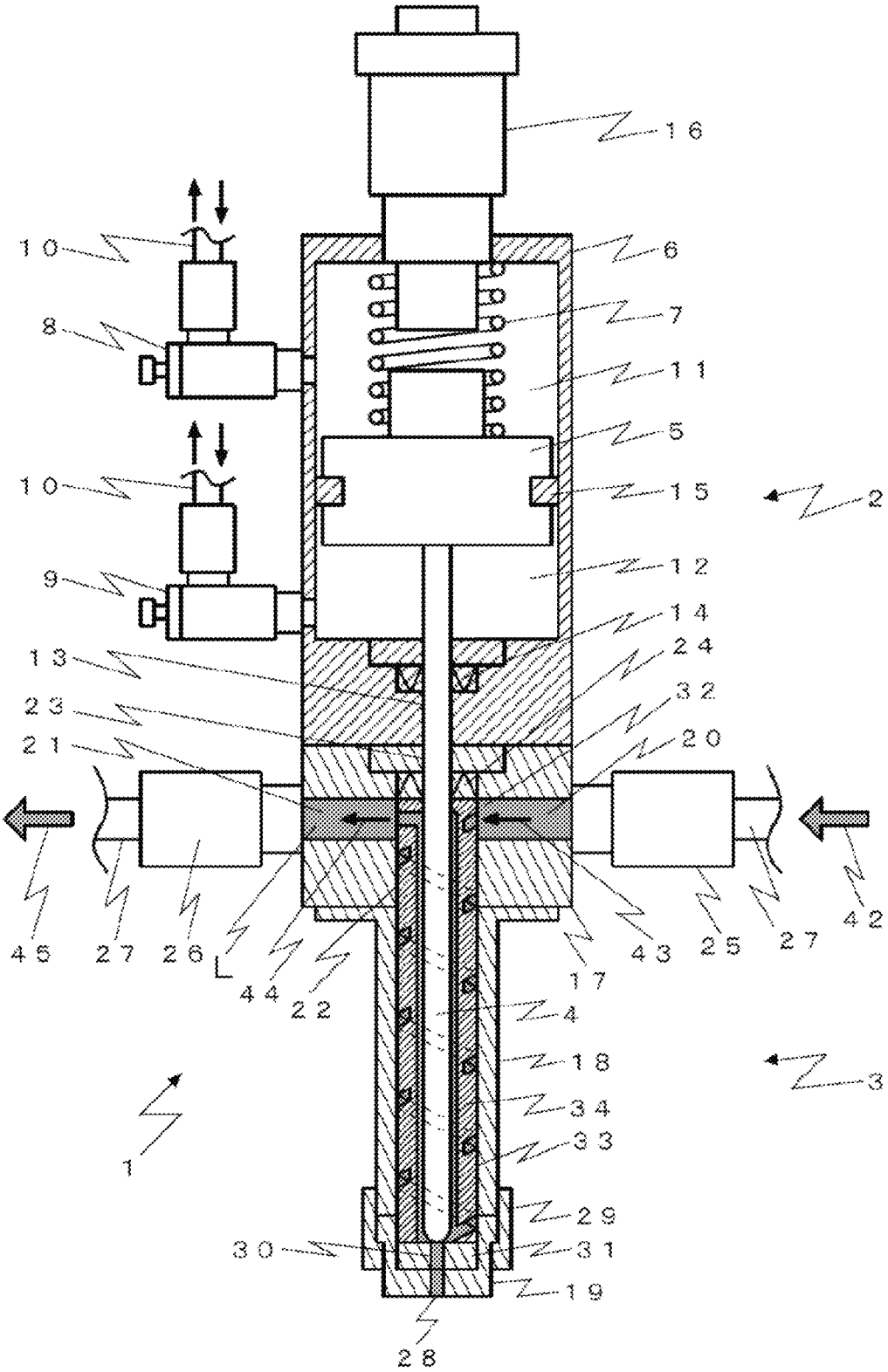
FIG. 1 is a sectional view of a liquid material discharge device according to a first embodiment.

FIG. 1 is a schematic sectional view of a liquid material discharge device 1 according to a first embodiment. A liquid material discharge device 1 used in this embodiment is based on a discharge device of needle valve type that a piston 5 is driven by force of compressed gas or a spring 7 to open and close a communication bore 30 of a valve seat 31 with a tip of a needle 4 fixed to the piston 5, whereby a liquid material L is discharged from a nozzle 19. While the discharge device 1 illustrated in FIG. 1 is to discharge the liquid material L in the form of dots or lines, the liquid material L can also be discharged in the form of a mist by replacing the nozzle 19.

A drive section 2 and a liquid contact section 3, which are main components of the discharge device 1 according to this embodiment, will be described in detail below.

[Drive Section]

The drive section 2 is constituted mainly by the piston 5 to which the needle 4 is fixed, a piston container 6 in which the piston 5 is contained in a movable manner, the spring 7 for biasing the piston 5 and the needle 4 toward the valve seat 31, and tube couplings (8, 9) for connecting tubes through which compressed gas for driving the piston 5 is supplied.

The piston container 6 is a member having an airtight space that is formed therein, and that is partitioned by the piston 5 into an upper piston chamber 11 and a lower piston chamber 12. The spring 7 is disposed in the upper piston chamber 11, and the lower piston chamber 12 serves as a chamber to which the compressed gas for driving the piston 5 is supplied. The upper tube coupling 8 and the lower tube coupling 9 are connected respectively to the piston chambers (11, 12) to supply and exhaust the compressed gas. Gas tubes 10 are connected to the tube couplings (8, 9) on the side opposite to the piston chambers (11, 12).

A sealing member C 15 is disposed around a lateral surface of the piston 5 to keep the inside of the upper piston chamber 11 airtight. A sealing member B 14 is disposed in a needle penetration bore B 13, which is formed in a bottom portion of the lower piston chamber 12, to keep the inside of the lower piston chamber 12 airtight.

A stroke adjustment member 16 for adjusting a movement amount of the piston 5 is fixed to an upper end of the piston container 6 such that a maximally retracted position of the piston 5 can be adjusted by changing an amount through which the stroke adjustment member 16 is projected into the inside of the upper piston chamber 11.

The piston 5 is biased by the spring 7 toward the valve seat 31 (downwards). In a state where the compressed gas is not supplied to the piston chambers (11, 12), the tip of the needle 4 is stopped at a position where the tip is in contact with the valve seat 31.

When the compressed gas is supplied to the lower piston chamber 12, the piston 5 is driven upwards against the force of the spring 7. At that time, gas within the upper piston chamber 11 is exhausted through the upper tube coupling 8. Subsequently, when the supply of the compressed gas to the lower piston chamber 12 is stopped and the compressed gas is supplied to the inside of the upper piston chamber 11, the piston 5 is driven downwards by the force of the spring 7. At that time, the gas within the lower piston chamber 12 is exhausted through the lower tube coupling 9.

The upper tube coupling 8 and the lower tube coupling 9 may be each provided with a speed control valve (speed controller). A driving speed of the piston 5 can be controlled by controlling a speed (flow rate) of the gas supplied to the piston chamber (11, 12) and of the gas exhausted from the piston chamber (11, 12) with the speed controller.

[Liquid Contact Section]

The liquid contact section 3 disposed under the drive section 2 in a continuous relation is constituted mainly by a liquid contact member 17, a needle container 18, a nozzle 19, and a flow passage formation member 34.

The liquid contact member 17 is a block-like member having flow passages and a needle penetration bore A 23 both formed therein. Inside the liquid contact member 17, there are formed a horizontal circulation flow passage 32 extending to penetrate through the liquid contact member 17 in a direction (e.g., horizontal direction) different from a direction in which the needle 4 extends, and an insertion bore 22 that is communicated with the horizontal circulation flow passage 32 sideways, and that extends from the horizontal circulation flow passage 32 to penetrate through the liquid contact member 17 in the same direction (e.g., downwards in a vertical direction) as the extending direction of the needle 4. In a structural example of FIG. 1, the horizontal circulation flow passage 32 and the insertion bore 22 constitute a flow passage having a T-shape, when viewed in a cross-section, within the liquid contact member 17. It is to be noted that the circulation flow passage in communication with the insertion bore 22 is not always required to be constituted by the horizontal penetration bore, and that the circulation flow passage may have a V-shape, for example.

In the liquid contact member 17, a needle penetration bore A 23 extending in the vertical direction is formed coaxially with the insertion bore 22. The needle 4 is inserted through the needle penetration bore A 23, and a sealing member A 24 is disposed between the needle 4 and an inner wall of the needle penetration bore A 23 to prevent leakage of the liquid material L toward the drive section 2.

The horizontal circulation flow passage 32 in this embodiment is partitioned by the flow passage formation member 34 into a first flow passage 20 on the right side in the drawing and a second flow passage 21 on the left side in the drawing. A liquid tube 27 is connected to the first flow passage 20 through a first connection coupling 25. Similarly, another liquid tube 27 is connected to the second flow passage 21 through a second connection coupling 26. The liquid tubes 27 connected to the couplings 25 and 26 are connected to a circulation mechanism 50 (described in detail later with reference to FIG. 3) for circulating the liquid material L of which temperature is adjusted. When the liquid material L is supplied from the first connection coupling 25, the first flow passage 20 takes a position on the upstream side and the second flow passage 21 takes a position on the downstream side. When the liquid material L is supplied from the second connection coupling 26, the first flow passage 20 takes a position on the downstream side and the second flow passage 21 takes a position on the upstream side. For convenience of explanation, the following description is made in connection with the case where the first flow passage 20 takes a position on the upstream side and the second flow passage 21 takes a position on the downstream side.

The needle container 18 having a cylindrical shape and provided with a flange at its upper end is detachably fixed under the liquid contact member 17. The flow passage formation member 34 inserted to the needle container 18 can be easily removed by disassembling the liquid contact member 17 and the needle container 18. A columnar liquid chamber 33 extending vertically is formed inside the needle container 18 to communicate the insertion bore 22 and the communication bore 30 with each other. The liquid chamber 33 is coaxial with both the insertion bore 22 and the needle penetration bore A 23. Preferably, a diameter of the liquid chamber 33 is substantially the same as an inner diameter of the insertion bore 22.

The valve seat 31 and the nozzle 19 are fixed to a lower end of the needle container 18 by a fixing member 29 in the form of a cap having a hole. The valve seat 31 is a disk-shaped member in which the communication bore 30 is formed at a center. A large part of an upper surface of the valve seat 31 faces an inner flow passage 35, and it is in a state always heated by the liquid material L in the inner flow passage 35. Thus, the valve seat 31 is preferably made of a metal having good thermal conductivity such that heat from the liquid material L is conducted to the communication bore 30. More preferably, the flow passage formation member 34 is made of a metal and an end surface of the flow passage formation member 34 is contacted with the upper surface of the valve seat 31 such that heat from the flow passage formation member 34 is conducted to the valve seat 31.

The nozzle 19 is a cup-shaped member for receiving the valve seat 31, and a discharge port 28 through which the liquid material L is discharged to the outside is formed at the center of the nozzle 19. One end of the liquid chamber 33, which is defined by a lower end opening of the needle container 18, is communicated with the discharge port 28 through the communication bore 30. When the tip of the needle 4 is moved away from the valve seat 31 by driving of the piston 5, the liquid material L is discharged from the discharge port 28, and when the tip of the needle 4 is contacted with the valve seat 31 by driving of the piston 5, the discharge of the liquid material L from the discharge port 28 is stopped. It is to be noted that the shape of the tip of the needle 4 is not limited to the illustrated one, and that the tip of the needle 4 may have any suitable shape insofar as the communication bore 30 can be closed by the needle tip.

[Flow Passage Formation Member]

Figure 2:
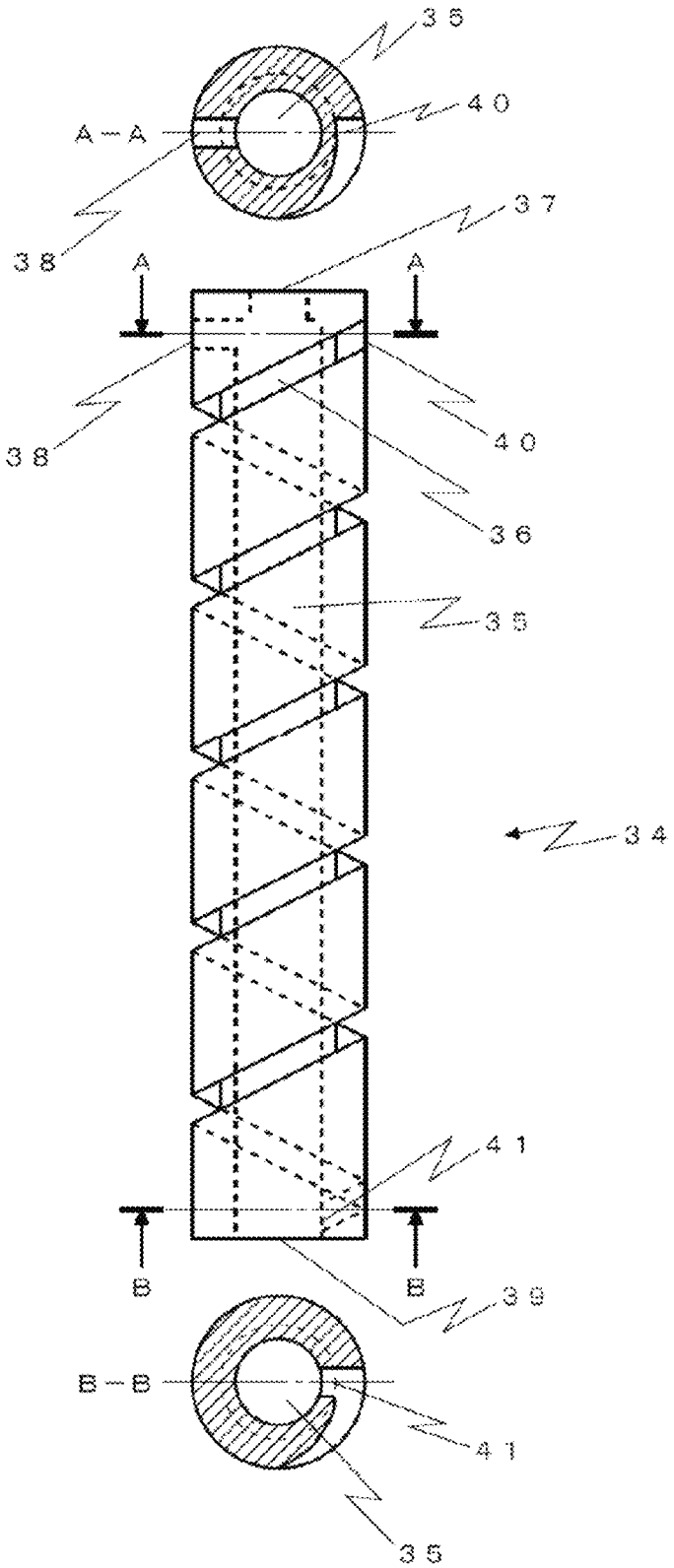
FIG. 2 depicts a side view and sectional views of a flow passage formation member according to the first embodiment.

FIG. 2 depicts a side view, an A-A sectional view, and a B-B sectional view of the flow passage formation member 34 according to this embodiment.

The flow passage formation member 34 is a cylindrical member having a length spanning from the sealing member A 24 (i.e., the upper end of the horizontal circulation flow passage 32) to the valve seat 31. An outer diameter of the flow passage formation member 34 is slightly smaller than the diameters of the insertion bore 22 and the liquid chamber 33, and the flow passage formation member 34 is detachably inserted in the insertion bore 22. Here, a difference between the outer diameter of the flow passage formation member 34 and the diameters of the insertion bore 22 and the liquid chamber 33 is minimized within a range not impeding insertion and detachment the flow passage formation member 34, in order to transfer the liquid material through an outer flow passage 36 without loss. In other words, the outer diameter of the flow passage formation member 34 is set such that respective inner walls of the insertion bore 22 and the liquid chamber 33 cooperate with an outer lateral surface of the flow passage formation member 34 to form the outer flow passage 36, which is in the shape of a recessed groove, as a closed flow passage. The flow passage formation member 34 is made of a heat-resistant material. For example, the flow passage formation member 34 is made of a metal such as stainless steel or an aluminum alloy, or a heat-resistant resin material such as PEEK (polyether ether ketone). The discharge device 1 can be constituted by fitting the flow passage formation member 34 to an existing discharge device provided with a columnar liquid chamber. In that case, the flow passage formation member 34 is fabricated in size fit for the shape of the liquid chamber of the existing discharge device. The shape of the flow passage formation member 34 is not limited to the cylindrical shape, and the flow passage formation member 34 may be, e.g., a rod-like tapered member provided with a penetration bore that extends in a lengthwise direction thereof, a rod-like member provided with a step on its lateral surface (i.e., including a large-diameter portion and a small-diameter portion), or a rod-like member having a polygonal cross-section.

The flow passage formation member 34 is a columnar member provided with the outer flow passage 36 having a top opening 40 formed at an upper end thereof and a bottom opening 41 formed at a lower end thereof, and with the inner flow passage 35 having a bottom opening 41 in communication with the outer flow passage 36 and a top opening 37 formed at an upper end thereof. In other words, the flow passage formation member 34 includes the inner flow passage 35 penetrating therethrough in the vertical direction (i.e., a direction along its center axis), and the outer flow passage 36 formed in its outer surface as a recessed groove in a surrounding relation to the inner flow passage 35.

A diameter of the inner flow passage 35 is set to be larger than that of the needle 4. In other words, the inner flow passage 35 is constituted in size providing a gap between an outer peripheral surface of the needle 4 and an inner peripheral surface of the inner flow passage 35 with intent not to impede reciprocating movement of the needle 4.

A needle penetration bore C 37 allowing the needle 4 to be inserted therethrough and communicating with the inner flow passage 35 is formed at an upper end of the inner flow passage 35. An inner diameter of the needle penetration bore C 37 is substantially the same as an outer diameter of the needle 4. The inner-flow-passage top opening 38 opened perpendicularly to a center axis (i.e., horizontally) is formed at a position slightly below the needle penetration bore C 37. The inner flow passage 35 is communicated with the outside of the flow passage formation member 34 through the inner-flow-passage top opening 38. An outflow hole 39 through which the communication bore 30 of the valve seat 31 and the inner flow passage 35 are communicated with each other is formed at a lower end of the inner flow passage 35.

The outer flow passage 36 is a single flow passage interconnecting the upper end and the lower end of the flow passage formation member 34 while extending around the flow passage formation member 34, and it is a recessed groove formed in the outer surface of the flow passage formation member 34. FIG. 2 illustrates, by way of example, a spiral groove as the simplest shape surrounding the inner flow passage 35 while extending from the upper end to the lower end of the flow passage formation member 34. However, the shape of the outer flow passage 36 is not limited to the spiral shape insofar as the outer flow passage 36 is a recessed groove formed in the outer surface of the flow passage formation member 34 so as to extend around the inner flow passage 35. The outer flow passage 36 is just required to function as a flow passage, and it can be implemented in any suitable shape. From the viewpoint of the manufacturing cost, however, the outer flow passage 36 is preferably constituted as a recessed groove opened to the outside and having a uniform cross-sectional area. The outer flow passage 36 may be constituted by arranging an even number of flow passages having the same shape in a symmetrical relation.

Furthermore, pump pulsation can be reduced by setting a length of the outer flow passage 36 to be longer than a certain value. The length of the outer flow passage 36 can be increased by forming the outer flow passage 36 in a state extending around the outer periphery of the flow passage formation member 34, e.g., two, three, four, five or more times. Increasing the length of the outer flow passage 36 to be longer than a certain value also contributes to reducing an amount of the material of the flow passage formation member 34. This leads to a technical effect of suppressing temperature reduction of the liquid material L when the flow passage formation member 34 is made of a metal.

The outer flow passage 36 and the inner flow passage 35 are communicated with each other only at the outer-flow-passage bottom opening (or an inner-flow-passage bottom opening) 41, and are not communicated with each other at any other positions. Stated in another way, the outer flow passage 36 and the inner flow passage 35 are separated by an outer peripheral wall of the flow passage formation member 34. The outer-flow-passage top opening 40 in communication with the outside of the flow passage formation member 34 is formed at the upper end of the outer flow passage 36, and the outer-flow-passage bottom opening 41 in communication with the inner flow passage 35 is formed at the lower end of the outer flow passage 36. As illustrated in the A-A sectional view of FIG. 2, the outer-flow-passage top opening 40 and the inner-flow-passage top opening 38 are preferably formed such that both the openings lie on a linear line passing the center of the flow passage formation member 34 and orient outwards oppositely. More preferably, axial positions (height positions) of the outer-flow-passage top opening 40 and the inner-flow-passage top opening 38 are located substantially at the same level. The reason is that the outer-flow-passage top opening 40 and the inner-flow-passage top opening 38 need to be communicated with the first flow passage 20 and the second flow passage 21, respectively, for circulation of the liquid material L (see FIG. 1).

On the other hand, the outer-flow-passage bottom opening 41 illustrated in the B-B sectional view of FIG. 2 may be formed to orient in any direction. The reason is that although the outer flow passage 36 in the flow passage formation member 34 is the groove in itself opened to the outside, it forms a closed (not-opened) flow passage covered with the inner peripheral surface of the needle container 18, as illustrated in FIG. 1, when assembled into the discharge device 1.

Sizes of the inner flow passage 35 and the outer flow passage 36 are described below in connection with specific examples.

For example, when the needle container 18 has a size of φ12 [mm]×40 [mm], the outer flow passage 36 is preferably formed in a cross-sectional area in the range of 1 to 6 [$mm^2$] and a length in the range of 20 to 80 [mm]. The diameter of the inner flow passage 35 is preferably formed in the range of 1.5 to 2.5 times the diameter of the needle 4. On the other hand, at least the first flow passage 20 is formed in a diameter of 4 to 6 [mm] (cross-sectional area of 12.6 to 28.3 [$mm^2$]) such that it has preferably a larger cross-sectional area (to be fatter), more preferably twice or more, and even more preferably triple or more than that of the outer flow passage 36. As a result, the outer flow passage 36 functions as resistance when the liquid material L flows through the circulation flow passage, thus making it possible to suppress pulsation of a pump 53 used for the circulation (namely, to prevent the pulsation from being transmitted to the discharge port 28 of the nozzle 19). More preferably, the diameter of the first flow passage 20 and the diameter of the second flow passage 21 are set to be the same. It is to be noted that the above-mentioned values may be adjusted, as required, depending on the physical properties of the liquid material L, the size of the discharge device 1, etc., and that the present invention is not limited to the above-mentioned exemplary numerical values.

[Liquid Material Filling Step]

A step of filling the liquid material L into the flow passages (35, 36) formed in the flow passage formation member 34 will be described below with reference to FIGS. 1 and 2. It is here assumed that the tip of the needle 4 is in a state contacted with the valve seat 31 and closing the communication bore 30.

As denoted by a reference symbol 42 in FIG. 1, the liquid material L is supplied to the first flow passage 20 from the liquid tube 27 through the first connection coupling 25, and reaches the flow passage formation member 34. Because the first flow passage 20 is not communicated with the second flow passage 21 by the presence of the flow passage formation member 34, the liquid material L flows into the outer-flow-passage top opening 40 of the flow passage formation member 34 (as denoted by a reference symbol 43 in FIG. 1). After flowing into the outer-flow-passage top opening 40, the liquid material L advances through the outer flow passage 36 downwards from the upper side while flowing around the outer periphery of the flow passage formation member 34, and reaches the outer-flow-passage bottom opening 41. After flowing out from the outer-flow-passage bottom opening 41, the liquid material L reaches the valve seat 31 and flows into the inner flow passage 35. Because the communication bore 30 of the valve seat 31 is closed by the tip of the needle 4, the liquid material L does not flow out to the outside through the discharge port 28 of the nozzle 19. After flowing into the inner flow passage 35 from the vicinity of the valve seat 31 (i.e., from a position near the lower end of the inner flow passage 35), the liquid material L flows upwards from the lower side through the gap between the inner flow passage 35 and the needle 4. After reaching the upper end of the inner flow passage 35, the liquid material L flows out from the inner-flow-passage top opening 38 toward the outside of the flow passage formation member 34 (as denoted by a reference symbol 44 in FIG. 1), and enters the second flow passage 21. The liquid material L having reached the second flow passage 21 flows into the liquid tube 27 through the second connection coupling 26 (as denoted by a reference symbol 45 in FIG. 1). After flowing into the liquid tube 27, the liquid material L is returned to a tank 51 (described later) and is supplied to the discharge device again by the pump 53 after temperature adjustment (namely, the liquid material L is circulated). The above is a basic flow of the step of filling the liquid material L into the flow passage formation member 34.

[Circulation Mechanism]

Figure 3:
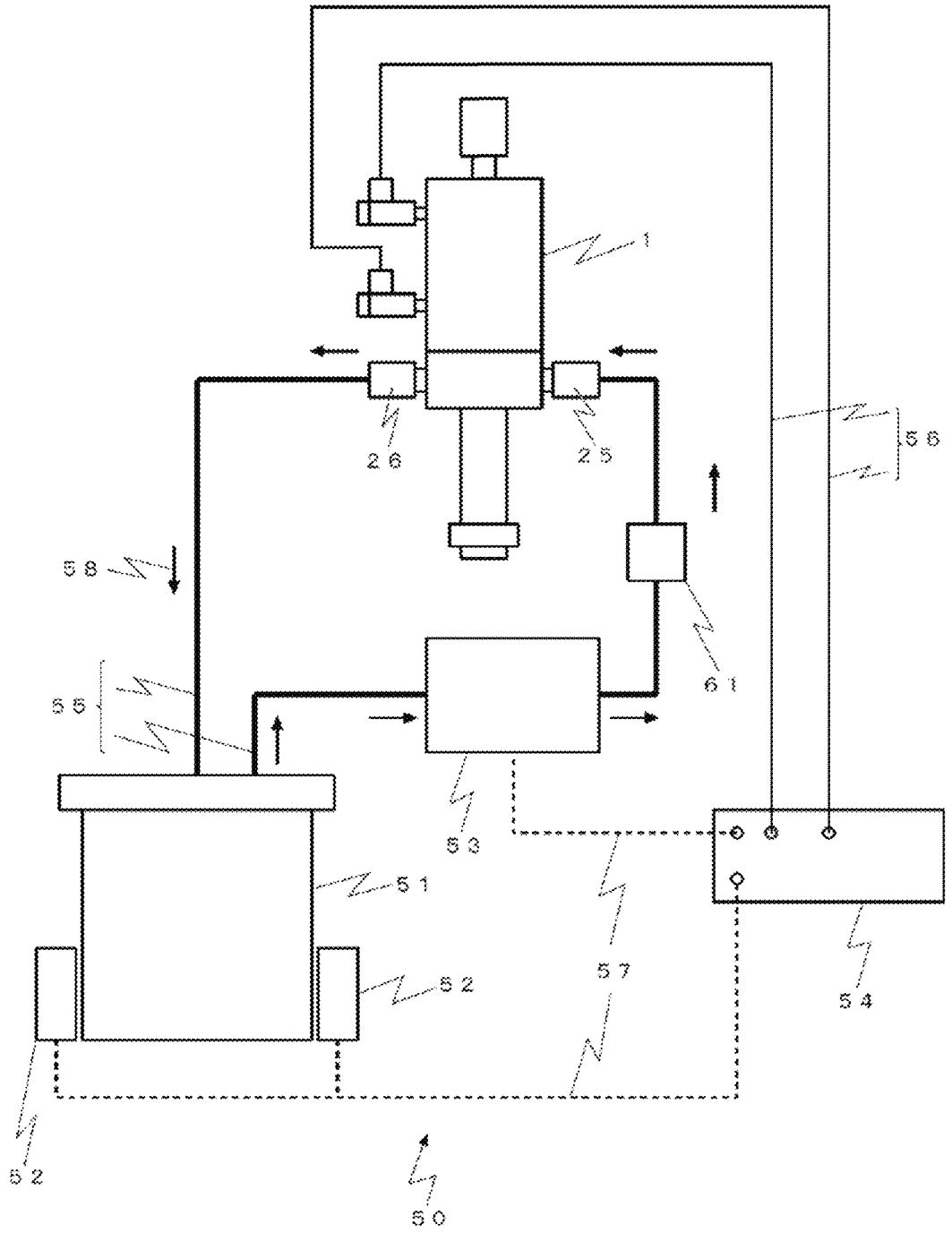
FIG. 3 is a block diagram of a circulation mechanism according to the first embodiment.

The discharge device 1 of this embodiment is connected to the circulation mechanism 50 for circulating the liquid material L. FIG. 3 illustrates an exemplary configuration of the circulation mechanism 50.

The circulation mechanism 50 illustrated in FIG. 3 includes the tank 51 for storing the liquid material L, a heater 52 for adjusting the temperature of the liquid material L stored in the tank 51, the pump 53 for sucking the liquid material L from the tank 51 for circulation, a controller 54 for controlling not only operations of the pump 53 and the heater 52, but also supply and exhaust of the compressed gas to and from the discharge device 1, and a regulator 61. In the discharge device 1 of this embodiment, since the discharge port 28 is disposed near the flow passages (35, 36) constituting the circulation flow passage and the influence of temperature reduction in the flow passage (30) branched from the circulation flow passage is small, temperature control of the liquid material L is easier than in a known discharge device including a circulation flow passage.

The tank 51 has a capacity sufficient for the discharge device 1 to perform the operation of applying the liquid material, and the liquid material in the tank is kept at a setting temperature by the heater 52. The tank 51 may include a stirrer for stirring the liquid material in the tank. Connected to the tank 51 are a liquid tubing line 55 through which the liquid material is delivered, and another liquid tubing line 55 through which the liquid material after having passed the discharge device 1 is recovered. The pump 53 is disposed between the former liquid tubing line 55 through which the liquid material is delivered and the discharge device 1. The liquid material L fed under pressure by the pump 53 flows to circulate through the tank 51→the pump 53→the regulator 61→the discharge device 1→the tank 51 successively, as denoted by a reference symbol 58. An amount of the discharged liquid material can be adjusted by regulating pressure of the liquid material L (i.e., discharge pressure) by the regulator 61. In this embodiment, although pulsation is generated due to circulation of the liquid material L by the pump 53, the pulsation is statically reduced through the flow passage formation member 34, and therefore an accumulator is not disposed in a circulation flow path of the circulation mechanism 50 (an accumulator may be disposed, for example, in the case of applying the liquid material with ultra-high precession).

The heater 52 and the pump 53 are connected to the controller 54 via a control wiring line 57, and their operations are controlled by the controller 54. The controller 54 is connected to the discharge device 1 via gas tubing lines 56, and it controls supply and exhaust of the compressed gas, thereby controlling the discharge operation. It is also possible to automatically regulate the pressure of the liquid material L (i.e., the discharge pressure) by employing an electro-pneumatic regulator as the regulator 61, and by connecting the controller 54 to the regulator 61.

For example, when the discharge device 1 is employed in use for coating an insulating moisture-proof agent over a circuit board, the setting temperature is 35 to 40° C. and the viscosity of the liquid material is 40 to 60 [mPa·s].

The discharge device 1 connected to the circulation mechanism 50 is mounted to an XYZ-direction moving apparatus (not illustrated), and an applying operation is performed while the discharge device 1 is moved relatively to a work table on which an application target is placed. The XYZ-direction moving apparatus can be constituted, for example, by a combination of an electric motor and a ball screw, a mechanism using a linear motor, or a mechanism for transmitting motive power through a belt or a chain.

With the circulation mechanism 50 described above, since the discharge port 28 is disposed near the circulation flow passage (20→36→35→21) within the discharge device 1, temperature reduction in the flow passage communicating the circulation flow passage and the discharge port with each other is minimized. Furthermore, since a flow passage structure in which the outer flow passage 36 extends around the inner flow passage 35 is disposed until reaching the lower end of the elongate needle container 18, prevention of temperature change of the liquid material L can be realized with high energy efficiency. Moreover, the pump pulsation can be statically reduced through the outer flow passage 36 having the cross-sectional area smaller than those of the first flow passage 20 and the second flow passage 21. In addition, in maintenance work, since the flow passage formation member 34 can be easily taken out from the insertion bore 22 and the outer flow passage 36 is in the form of a recessed groove opened to the outside, it is easy to remove stains. Accordingly, the discharge device is suitably used to discharge even a liquid material containing filler or a liquid material curing over time such as an adhesive.

The above description is premised on the case where the liquid material L is supplied from the first connection coupling 25 and is taken out from the second connection coupling 26, the effect of the present invention, i.e., the advantages of keeping the liquid material L less apt to cool and enabling the pump pulsation to be reduced, can also be developed even when the liquid material L is supplied from the second connection coupling 26 and is taken out from the first connection coupling 25.

Second to Fifth Embodiments

Figure 4:
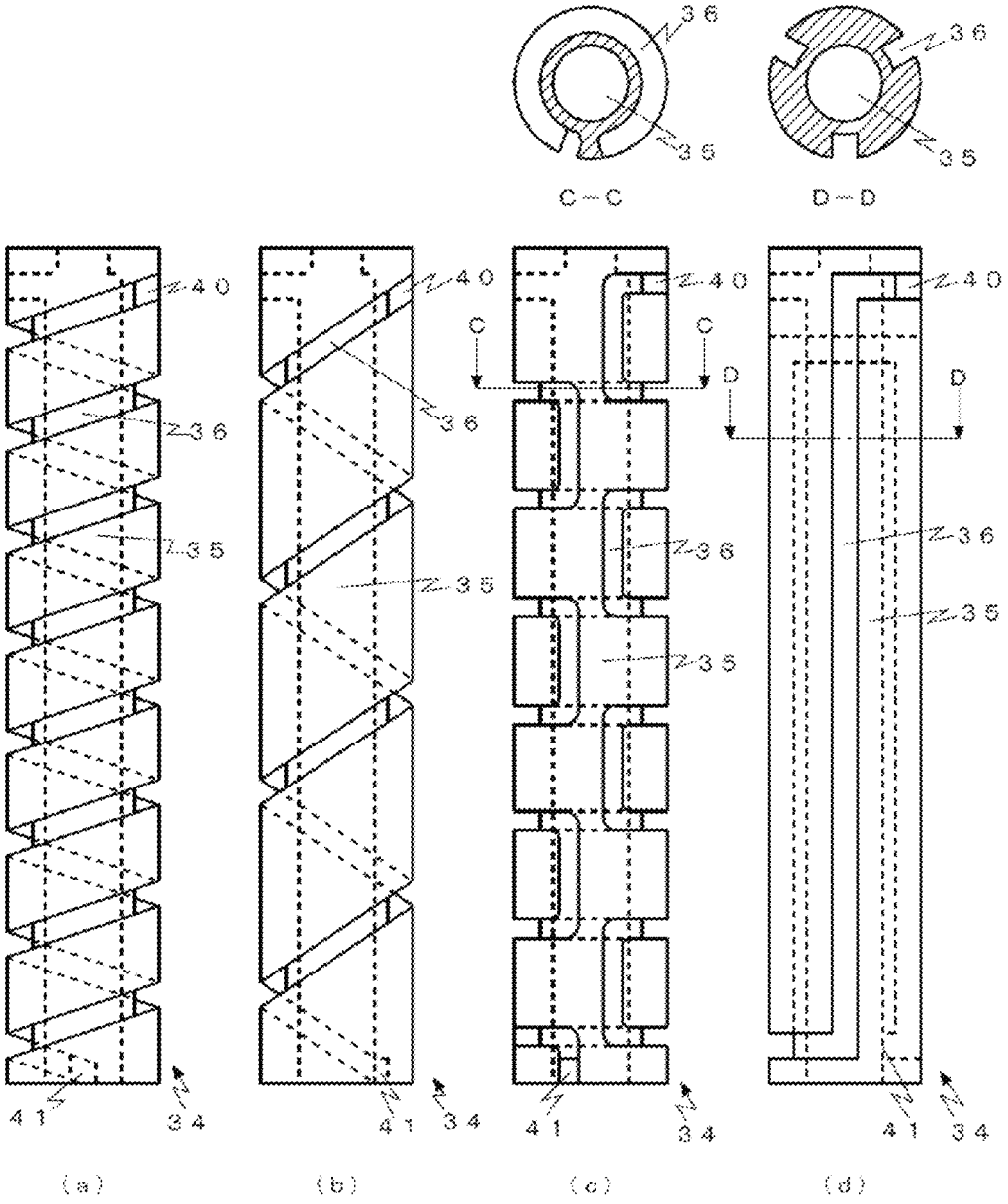
FIG. 4 depicts side views and sectional views illustrating variations of outer flow passages in flow passage formation members according to second to fifth embodiments. More specifically, FIG. 4(*a*) represents the second embodiment, FIG. 4(*b*) represents the third embodiment, FIG. 4(*c*) represents the fourth embodiment, and FIG. 4(*d*) represents the fifth embodiment.

The second to fifth embodiments are different from the first embodiment in the shape of the outer flow passage 36 in the flow passage formation member 34, but the other points are the same as in the first embodiment. Outer flow passages 36 formed in flow passage formation members 34, disclosed in the following embodiments, are each in the form of one continuous groove having a uniform cross-sectional area, and optimum one of the embodiments is selected depending on the physical properties of the liquid material L, the application conditions, etc. FIG. 4 depicts the flow passage formation members 34 according to the second to fifth embodiments. The flow passage formation members 34 according to the second to fifth embodiments are each cylindrical, and shapes of inner flow passages 35 are each the same as in the first embodiment. Therefore, description of the inner flow passages 35 is omitted.

FIG. 4(*a*) represents the flow passage formation member 34 according to the second embodiment. The second embodiment is similar to the first embodiment in that the outer flow passage 36 is formed by a spiral groove, but it is different from the first embodiment in that the interval between adjacent parts of the outer flow passage 36 is narrower than the interval in the first embodiment, and that the number of turns of the outer flow passage 36 extending around the flow passage formation member 34 is increased in the second embodiment. The second embodiment is suitable when a length of the outer flow passage 36 is required to be long as in the case of, for example, a liquid material L having comparatively low viscosity or a liquid material L being comparatively more susceptible to temperature change.

FIG. 4(*b*) represents the flow passage formation member 34 according to the third embodiment. The third embodiment is similar to the first embodiment in that the outer flow passage 36 is formed by a spiral groove, but it is different from the first embodiment in that the interval between adjacent parts of the outer flow passage 36 is wider than the interval in the first embodiment, and that the number of turns of the outer flow passage 36 extending around the flow passage formation member 34 is decreased in the third embodiment. The third embodiment is suitable when a length of the outer flow passage 36 is required to be short as in the case of, for example, a liquid material L having comparatively high viscosity or a liquid material L being comparatively less susceptible to temperature change.

FIG. 4(*c*) represents the flow passage formation member 34 according to the fourth embodiment, and an upper drawing is a C-C sectional view. In the fourth embodiment, one basic groove pattern is constituted by forming a groove extending in a first direction, i.e., in a circumferential direction of the flow passage formation member 34 and in the horizontal direction, over a length in the range of 60 to 90% of a circumference of the flow passage formation member 34, then forming a groove extending in the vertical direction, and further forming a groove extending in a second direction, which is reversed to the first direction by 180 degrees, over a length in the range of 60 to 90% of the circumference of the flow passage formation member 34. By repeatedly forming the basic groove pattern plural times, the outer flow passage 36 is formed as a groove that continuously extends from the vicinity of the upper end of the flow passage formation member 34 to the vicinity of the lower end thereof. Comparing the length of the outer flow passage 36 per unit axial length (i.e., for each basic groove pattern), a longer passage length can be obtained in the fourth embodiment than in the second embodiment. The fourth embodiment is suitable for the case where the length of the outer flow passage 36 having the spiral shape is not sufficient.

FIG. 4(*d*) represents the flow passage formation member 34 according to the fifth embodiment, and an upper drawing is a D-D sectional view. The outer flow passage 36 is formed by forming one or more grooves, each axially extending from the upper end to the lower end of the flow passage formation member 34, in continuation with one or more grooves that extend in the circumferential direction and in the horizontal direction. In the fifth embodiment, the length of the outer flow passage 36 can be shortened to a minimum in comparison with the second to fourth embodiments. The fifth embodiment is suitable for the case where the overall length of the outer flow passage 36 is to be shortened while the outer flow passage 36 is formed to extend in the lengthwise direction of the inner flow passage 35. Although the outer flow passage 36 having three long vertical passages are formed in the fifth embodiment (see the D-D sectional view), the outer flow passage can also be formed as, e.g., 4 to 10 long parallel vertical passages by narrowing the interval between the vertical passages in the circumferential direction. Furthermore, the number of the parallel vertical passages constituting the outer flow passage 36 may be set to an optimum value by increasing or decreasing the cross-sectional area of the outer flow passage 36 such that the desired overall length of the outer flow passage is obtained.

Sixth to Ninth Embodiments

The sixth to ninth embodiments are different from the first to fifth embodiments in the shape of the outer flow passage 36 in the flow passage formation member 34, but the other points are the same as in the first to fifth embodiments. The sixth to ninth embodiments are different from the first to fifth embodiments in that, while the intervals between adjacent parts of the outer flow passage 36 in the axial direction are even in the first to fifth embodiments, the intervals between adjacent parts of the outer flow passage 36 in the axial direction are not even in the sixth to ninth embodiments. The flow passage formation members 34 according to the sixth to ninth embodiments are each cylindrical, and shapes of inner flow passages 35 are each the same as in the first to fifth embodiments. Therefore, description of the inner flow passages 35 is omitted.

Figure 5:
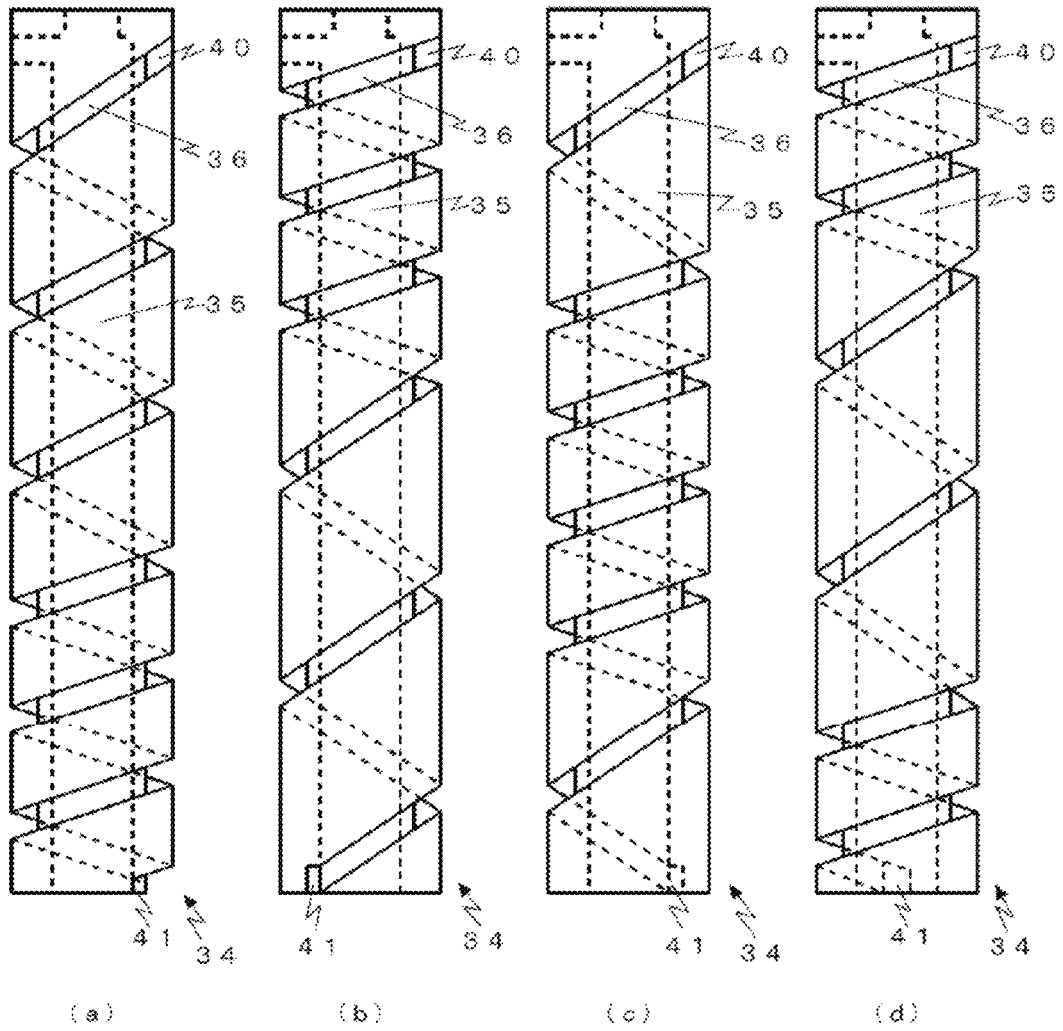
FIG. 5 depicts side views of flow passage formation members according to sixth to ninth embodiments. More specifically, FIG. 5(*a*) represents the sixth embodiment, FIG. 5(*b*) represents the seventh embodiment, FIG. 5(*c*) represents the eighth embodiment, and FIG. 5(*d*) represents the ninth embodiment.

FIG. 5(*a*) represents the flow passage formation member 34 according to the sixth embodiment. In the sixth embodiment, the interval between adjacent parts of the outer flow passage 36 in the axial direction is wide in an upper region, and the interval therebetween is narrow in a lower region.

FIG. 5(*b*) represents the flow passage formation member 34 according to the seventh embodiment. In the seventh embodiment, the interval between adjacent parts of the outer flow passage 36 in the axial direction is narrow in an upper side, and the interval therebetween is wide in a lower region.

FIG. 5(*c*) represents the flow passage formation member 34 according to the eighth embodiment. In the eighth embodiment, the interval between adjacent parts of the outer flow passage 36 in the axial direction is wide in upper and lower regions, and the interval therebetween is narrow in a middle region.

FIG. 5(*d*) represents the flow passage formation member 34 according to the ninth embodiment. In the ninth embodiment, the interval between adjacent parts of the outer flow passage 36 in the axal direction is narrow in upper and lower regions, and the interval therebetween is wide in a middle region.

As a result, a temperature difference can be given to the liquid material L in the inner flow passage 35 such that the temperature in the region where the interval is narrow is relatively high, and that the temperature in the region where the interval is wide is relatively low. While the sixth to ninth embodiments have been described, by way of example, in connection with the case of the spiral flow passage, it is also of course practicable, in the not-spiral flow passages as in the fourth embodiment (FIG. 4(*c*)) and the fifth embodiment (FIG. 4(*d*)), to set uneven the intervals between adjacent parts of the outer flow passage 36 in the axial direction. Furthermore, the intervals between adjacent parts of the outer flow passage 36 in the axial direction may be set to an optimum value by increasing or decreasing the cross-sectional area of the outer flow passage 36.

Tenth to Eleventh Embodiments

Figure 6:
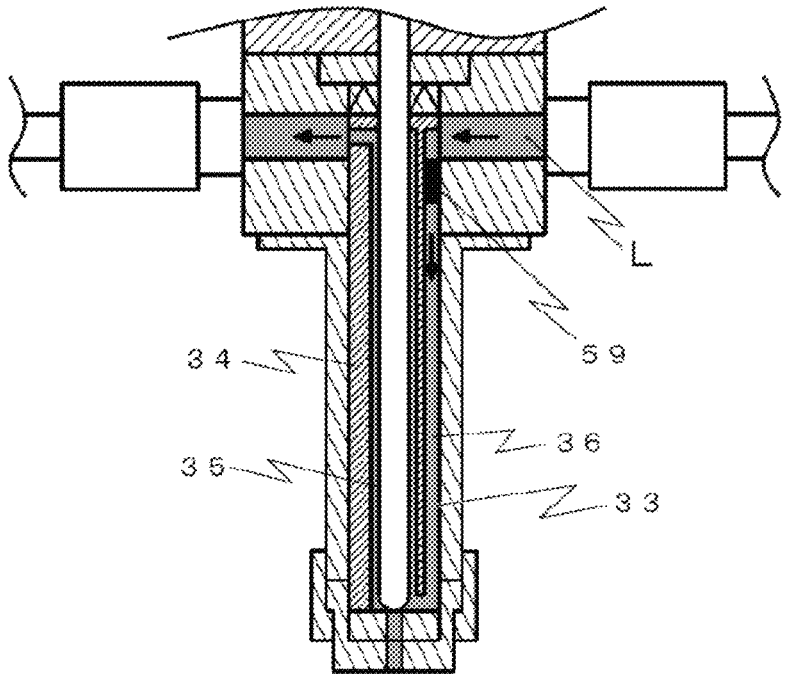
FIG. 6 depicts partial sectional views of liquid material discharge devices according to tenth and eleventh embodiments. More specifically, FIG. 6(*a*) represents the tenth embodiment, and FIG. 6(*b*) represents the eleventh embodiment.
Figure 6:
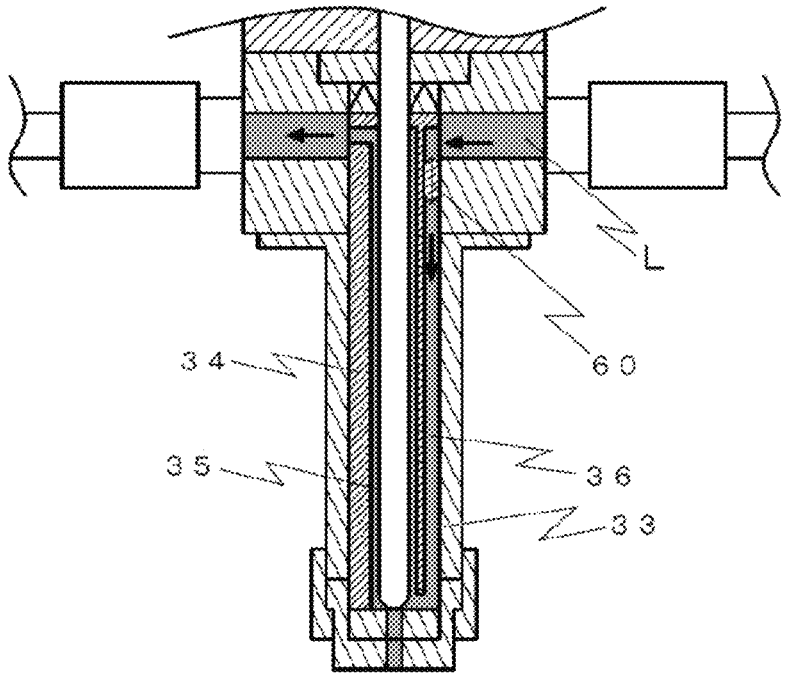
Figure 7:
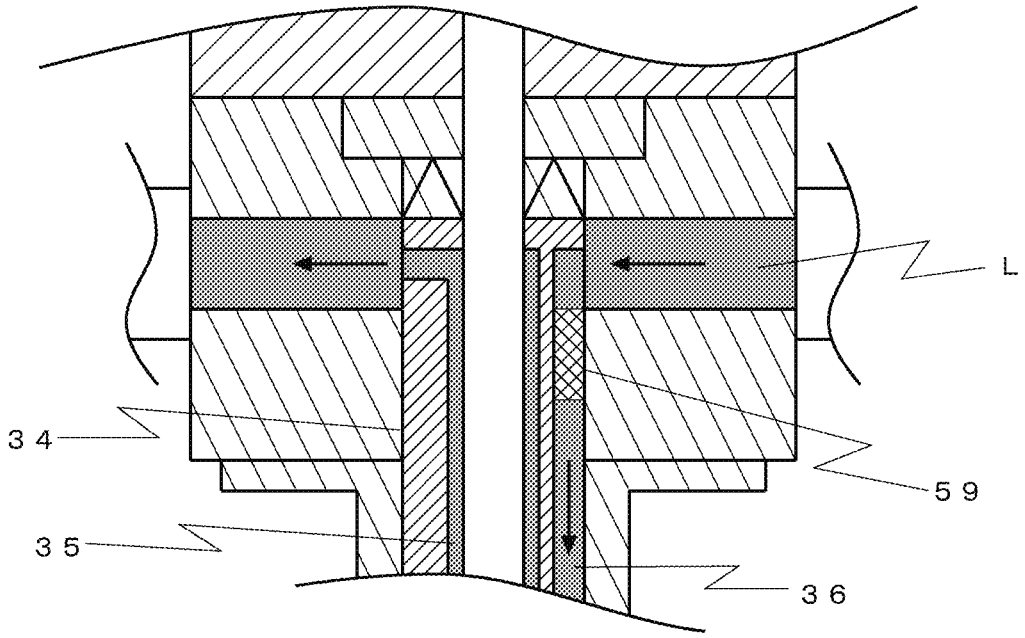
FIG. 7 depicts partial enlarged views of FIG. 6.
Figure 7:
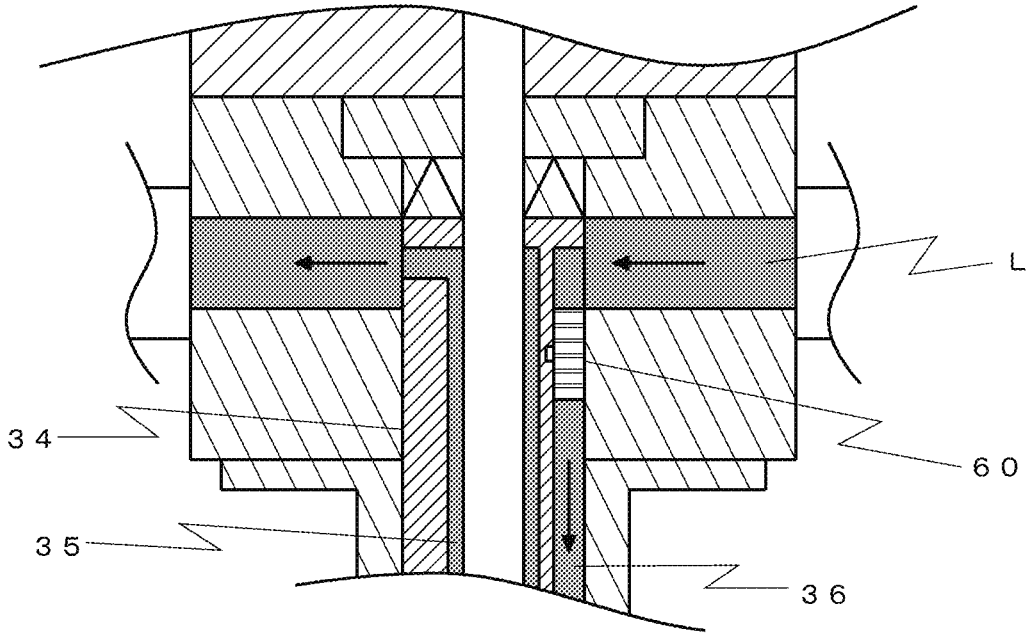

FIG. 6(*a*) is a side sectional view of a liquid contact section in a discharge device 1 according to a tenth embodiment. An outer flow passage 36 extending in the axial direction as in the fifth embodiment (FIG. 4(*d*)) is formed in a flow passage formation member 34 in the tenth embodiment. A porous member 59 serving to increase flow resistance is fixedly disposed at a position near a top opening 40 of the outer flow passage 36 (please also see FIG. 7(*a*)). Because the porous member 59 having a large number of pores, it does not completely block off the flow of the liquid material L. The porous member 59 involves not only a member having pores formed at random, but also a member having pores formed regularly. The number of the porous member 59, which is disposed midway the outer flow passage 36, is not limited to one, and the flow resistance may be adjusted by disposing the plurality of porous members 59. With the tenth embodiment, effective suppression of the pump pulsation can be realized even when a sufficient length of the outer flow passage 36 cannot be obtained. In addition, with the tenth embodiment, since the cross-sectional area of the outer flow passage 36 can be increased, easiness in maintenance of the outer flow passage 36 can be improved.

FIG. 6(*b*) is a side sectional view of a liquid contact section in a discharge device 1 according to an eleventh embodiment. An outer flow passage 36 similar to that in the tenth embodiment is formed in a flow passage formation member 34 in the eleventh embodiment. A waterwheel member 60 serving to increase flow resistance is fixedly disposed at a position near a top opening 40 of the outer flow passage 36 (please also see FIG. 7(*b*)). The flow resistance can be adjusted by adjusting a rotation load of the waterwheel member 60. The number of the waterwheel member 60, which is disposed midway the outer flow passage 36, is not limited to one, and the flow resistance may be adjusted by disposing the plurality of waterwheel members 60. With the eleventh embodiment, as with the tenth embodiment, effective suppression of the pump pulsation can be realized even when the length of the flow passage is relatively short, and easiness in maintenance can be improved by increasing the cross- sectional area of the outer flow passage 36.

LIST OF REFERENCE SIGNS

1: liquid material discharge device, 2: drive section, 3: liquid contact section, 4: needle, 5: piston, 6: piston container, 7: spring, 8: upper tube coupling, 9: lower tube coupling, 10: gas tube, 11: upper piston chamber, 12: lower piston chamber, 13: need penetration bore B, 14: sealing member B, 15: sealing member C, 16: stroke adjustment member, 17: liquid contact member, 18: needle container, 19: nozzle, 20: first flow passage, 21: second flow passage, 22: insertion bore, 23: needle penetration bore A, 24: sealing member A, 25: first connection coupling, 26: second connection coupling, 27: liquid tube, 28: discharge port, 29: fixing member, 30: communication bore, 31: valve seat, 32: horizontal circulation flow passage, 33: liquid chamber, 34: flow passage formation member, 35: inner flow passage, 36:

outer flow passage, 37: needle penetration bore C, 38: inner-flow-passage top opening, 39: outflow hole (inner-flow-passage bottom opening), 40: outer-flow-passage top opening, 41: outer-flow- passage bottom opening, 42, 43, 44, 45: flow of liquid material, 50: circulation mechanism, 51: tank, 52: heater, 53: pump, 54: controller, 55: liquid tubing line, 56: gas tubing line, 57: control wiring line, 58: circulation flow, 59: porous member, 60: waterwheel member, 61: regulator, L: liquid material

The invention claimed is:

1. A liquid material discharge device comprising a nozzle having a discharge port that is opened downwards, a valve seat having a communication bore in communication with the discharge port, a liquid chamber extending vertically and communicating with the communication bore, a needle that is moved inside the liquid chamber in a reciprocating manner to open and close the communication bore of the valve seat, and a circulation flow passage through which the liquid material is supplied to the liquid chamber, wherein the discharge device further comprises a rod-shaped flow passage formation member provided with an outer flow passage having a top opening formed at an upper end thereof and a bottom opening formed at a lower end thereof, and with an inner flow passage having an outflow bottom hole in communication with the communication bore of the valve seat and a top opening formed at an upper end thereof, the bottom opening of the outer flow passage being connected to the inner flow passage at the lower end of the flow passage formation member, the flow passage formation member is inserted into the liquid chamber in a state that the bottom opening of the outer flow passage and the outflow bottom hole of the inner flow passage are communicated with the communication bore of the valve seat, a bottom end of the flow passage formation member contacting a top surface of the valve seat, the bottom opening of the outer flow passage being located adjacent to the valve seat such that a top surface of the valve seat faces the inner flow passage, the top surface of the valve seat cooperating with a bottom face of the passage formation member defining the bottom opening of the outer flow passage, the circulation flow passage is constituted by:

(i) a first flow passage that extends in a direction different from an extending direction of the needle, and that is communicated with the top opening of the outer flow passage in the flow passage formation member, (ii) a second flow passage that extends in a direction different from the extending direction of the needle, and that is communicated with the top opening of the inner flow passage in the flow passage formation member, (iii) the outer flow passage in the flow passage formation member, and (iv) the inner flow passage in the flow passage formation member, the first flow passage penetrates the liquid material discharge device in the direction different from the extending direction of the needle, and a cross-sectional area of the outer flow passage in the flow passage formation member is smaller than a cross-sectional area of entire of the first flow passage such that the outer flow passage has flow resistance which is higher than flow resistance of the first flow passage, and wherein the needle is inserted into the inner flow passage and the outer flow passage is constituted by a groove recessed in an outer peripheral surface of the flow passage formation member, wherein the inner flow passage is constituted in size providing a gap between an outermost side surface of the needle and an innermost side surface of the flow passage formation member such that the liquid material circulates by flowing from the bottom opening of the outer flow passage into the outflow bottom hole of the inner flow passage or from the outflow bottom hole of the inner flow passage into the bottom opening of the outer flow passage.

2. The liquid material discharge device according to claim 1, wherein the cross-sectional area of the outer flow passage in the flow passage formation member is not more than ½ of the cross-sectional area of the first flow passage.

3. The liquid material discharge device according to claim 1, wherein the inner flow passage in the flow passage formation member is constituted by a penetration bore penetrating through the flow passage formation member, and an outer diameter of the flow passage formation member is set such that an inner wall of the liquid chamber cooperates with an outer lateral surface of the flow passage formation member to form the outer flow passage as a closed flow passage.

4. The liquid material discharge device according to claim 3, wherein the outer flow passage in the flow passage formation member extends around the flow passage formation member once or more in a region from an inlet to an outlet of the outer flow passage.

5. The liquid material discharge device according to claim 4, wherein the outer flow passage in the flow passage formation member is spirally formed.

6. The liquid material discharge device according to claim 1, further comprising a needle container having the liquid chamber formed therein, and a liquid contact member having the first flow passage and the second flow passage, wherein the needle container and the liquid contact member are detachably fixed.

7. The liquid material discharge device according to claim 6, wherein the first flow passage and the second flow passage are constituted by bore that extends within the liquid contact member in a horizontal direction, and that is separated with the presence of the flow passage formation member.

8. The liquid material discharge device according to claim 1, wherein a porous member or a waterwheel member is disposed in the outer flow passage in the flow passage formation member.

9. The liquid material discharge device according to claim 1, comprising a tank for storing the liquid material;

a heater for adjusting a temperature of the liquid material;

a pump for delivering the liquid material from the tank to the first flow passage or the second flow passage;

a circulation tubing line that interconnects the tank, the pump, the first flow passage, and the second flow passage; and a controller, wherein the liquid material kept at an adjusted temperature is supplied to the liquid chamber in a circulated manner.

10. The liquid material discharge device according to claim 9, wherein the pump delivers the liquid material to the first flow passage.

11. The liquid material discharge device according to claim 10, wherein the pump delivers the liquid material to the second flow passage.

12. A liquid material discharge method of discharging a liquid material, which is kept at an adjusted temperature, from a discharge port with the liquid material discharge device according to claim 9.

13. A liquid material discharge method of discharging a liquid material, which is kept at an adjusted temperature, from a discharge port with the liquid material discharge device according to claim 10.

14. A liquid material discharge method of discharging a liquid material, which is kept at an adjusted temperature, from a discharge port with the liquid material discharge device according to claim 11.

15. The liquid material discharge device according to claim 1, wherein the flow passage formation member includes a tube-shaped wall member, the outer flow passage being provided on an outer surface of the wall member and the inner flow passage being provided on an inner surface of the wall member.

16. The liquid material discharge device according to claim 1, wherein the outer flow passage is a single flow passage which interconnects the upper end and the lower end of the flow passage formation member.

* * * * *